US006309118B1

(12) United States Patent
Konno et al.

(10) Patent No.: US 6,309,118 B1
(45) Date of Patent: Oct. 30, 2001

(54) INK RIBBON

(75) Inventors: Akihiko Konno; Satoru Shinohara; Hiroshi Fukuda, all of Miyagi (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/588,290

(22) Filed: Jun. 7, 2000

(30) Foreign Application Priority Data

Jun. 16, 1999 (JP) ..... P11-170130
Sep. 16, 1999 (JP) ..... P11-262689

(51) Int. Cl.[7] ..... B41J 33/00

(52) U.S. Cl. ..... 400/237; 400/240.3; 400/224.2; 400/227

(58) Field of Search ..... 400/240.3, 120, 400/120.02, 224.2, 226, 191–250; 503/227

(56) References Cited

U.S. PATENT DOCUMENTS 4,558,329 12/1985 Honda ..... 346/76
5,073,053 * 12/1991 Kashiwagi ..... 400/240.3
5,185,315 * 2/1993 Sparer ..... 503/227
5,306,097 * 4/1994 Kaneko ..... 400/120
6,071,024 * 9/1998 Chi-Ming et al. ..... 400/120.02

FOREIGN PATENT DOCUMENTS

0673786A1 9/1995 (EP) .
0956972A1 11/1999 (EP) .
60008089 1/1985 (JP) .
01202491 8/1989 (JP) .

* cited by examiner

*Primary Examiner*—John S. Hilten
*Assistant Examiner*—Marvin P. Crenshaw
(74) *Attorney, Agent, or Firm*—Sonnenschein, Nath & Rosenthal

(57) ABSTRACT

An ink ribbon adapted to be used for a sublimation type thermal transfer printer, said ink ribbon comprises a ribbon-shaped substrate, ink layers formed on a surface of said substrate and containing dyes, sensor marks formed on said surface of said substrate and a back coat layer formed on the other surface of said substrate, said sensor marks containing first carbon black with an average particle diameter of 30 nm or less and second carbon black with an average particle diameter of 270 nm or more. Such an ink ribbon significantly improve the reliability of detecting sensor marks and the shelf life.

3 Claims, 5 Drawing Sheets

INK RIBBON

RELATED APPLICATION DATA

The present application claims priority to Japanese Application No. P11-170130 filed Jun. 16, 1999 and Japanese Application P11-262689 filed Sep. 16, 1999, which applications are incorporated herein by reference to the extent permitted by law.

BACKGROUND OF THE INVENTION

This invention relates to an ink ribbon having sensor marks and adapted to be used for thermal transfer recording. More particularly, it relates to an ink ribbon having sensor marks that can reliably be read in use.

Sublimation type thermal transfer recording methods for forming an image by laying an ink ribbon having ink layers containing sublimating or thermally diffusive dyes and printing paper having a dye receiving layer one on the other, heating the ink layers typically by means of a thermal head according to the image information applied to it and transferring the dyes of the ink layers to the dye receiving layer of the printing paper are known. Such sublimation type thermal transfer recording methods are attracting attention because they can form a full color image with continuously changing color tones particularly in the case of making a hard copy of an image from a video tape.

The sublimation type thermal transfer recording method is used with a printer that is adapted to use an ink ribbon typically provided with sensor marks for placing the ink ribbon in position. Since the sensor marks and the ink layers show respective optical translucent density that are different from each other, the printer using the ink ribbon can detect a sensor mark by way of a change in the translucent density of the ink ribbon to place the latter in position. The sensor marks are required to be reliably read by the sensor of the printer.

The sensor of the printer may be of the transmission type and or of the transmission/reflection type.

Referring to FIGS. 1 and 2 of the accompanying drawings, the sensor of the transmission type has a light emitting section 12 arranged to face the side of an ink ribbon 10 that carries sensor marks 11 and a light receiving section 13 arranged opposite to the light emitting section 12 so as to allow the ink ribbon 10 to pass therebetween.

The light emitting section 12 of the transmission type sensor emits light, which is received by the light receiving section 13. As shown in FIG. 1, light emitted from the light emitting section 12 passes through the ink ribbon 10 in areas other than those of the sensor marks 11 and received by the light receiving section 13. However, the sensor marks 11 block light so that light emitted from the light emitting section 12 cannot pass therethrough. In this way, the transmission type sensor detects each sensor mark 11.

In the case of the transmission/reflection type sensor as shown in FIGS. 3 and 4, a reflector panel 14 is arranged at the side of the ink ribbon 10 opposite to the side that carries sensor marks 11. Both a light emitting section 12 and a light receiving section 13 are arranged opposite to the reflector panel 14 so as to allow the ink ribbon 10 to pass therebetween. The light emitting section 12 and the light receiving section 13 are located at respective positions that are conjugative relative to each other.

Thus, the light emitting section 12 of the transmission/reflection type sensor emit light, which is reflected by the reflector panel 14 and received by the light receiving section 13. As shown in FIG. 3, light emitted from the light emitting section 12 passes through the ink ribbon 10 in areas other than those of the sensor marks 11 and reflected by the reflector panel 14 before it is received by the light receiving section 13. However, the sensor marks 11 block light so that light emitted from the light emitting section 12 cannot pass therethrough. In this way, the transmission/reflection type sensor detects each sensor mark 11.

The reliability of detecting sensor marks 11 of the transmission type sensor can be improved by using thick sensor marks 11.

However, if the sensor marks 11 are too thick, they can be deformed while the ink ribbon 10 is stored for a long period of time as high pressure is applied to them by the parts of the ink ribbon 10 that are held in contact with them.

In view of this problem, it is desirably that the sensor marks 11 has a thickness same as that of the ink layers, which is normally about 2 $\mu$m or less. In other words, the sensor marks 11 have to meet both the requirement of a small thickness and that of a high translucent density.

Additionally, in the case of the transmission/reflection type sensor, if the sensor marks 11 show a high surface reflectance, the light receiving section 13 can receive light reflected not by the reflector panel 14 but by the adjacent surface of a sensor mark 11 and mistake the sensor mark 11 for an area other than the sensor mark 11. Then, the sensor mark 11 is not correctly recognized to give rise to misalignment of the ink ribbon 10 and a failure on the part of the printer.

Efforts have been paid to optimize the chemical composition and the thickness of sensor marks 11 in order to optimize the translucent density and the surface reflectance of sensor marks 11. However, the problem of missing sensor marks of the sensor has not been completely eliminated to date.

In view of the above described circumstances, it is therefore the object of the present invention to provide an ink ribbon to be used for thermal transfer recording that shows an improved reliability for detecting sensor marks and can be stored without losing the improved reliability.

SUMMARY OF THE INVENTION

According to the invention, the above object is achieved by providing an ink ribbon adapted to be used for a sublimation type thermal transfer printer, said ink ribbon comprising:

a ribbon-shaped substrate;

ink layers formed on a surface of said substrate and containing dyes;

sensor marks formed on said surface of said substrate; and a back coat layer formed on the other surface of said substrate;

said sensor marks containing first carbon black with an average particle diameter of 30 nm or less and second carbon black with an average particle diameter of 270 nm or more.

With an ink ribbon according to the invention as described above, the sensor marks satisfy both the requirement of a high translucent density and that of a low surface reflectance to minimize detection errors.

In another aspect of the invention, there is also provided an ink ribbon adapted to be used for a sublimation type thermal transfer printer, said ink ribbon comprising:

a ribbon-shaped substrate;

ink layers formed on a surface of said substrate and containing dyes; and sensor marks formed on said surface of said substrate carrying said ink layers;

said sensor marks having a 45° reflectance of 30% or less to light with a wavelength of 950 nm.

With an ink ribbon according to the invention, the sensor of the printer can reliably detect the sensor marks because the surface reflectance of the sensor marks is sufficiently low.

DESCRIPTION OF THE PREFERRED EMBODIMENTS

Now, the present invention will be described in greater detail by referring to the accompanying drawings that illustrate preferred embodiments of the invention.

Figure 1:
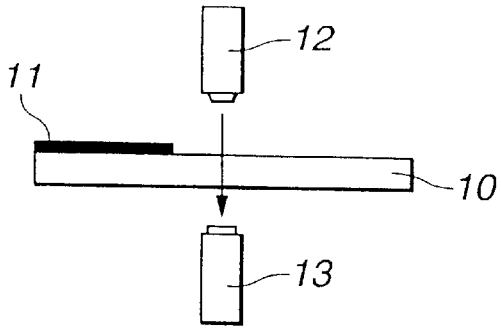
FIG. 1 is a schematic illustration of a transmission type sensor detecting a sensor mark.
Figure 2:
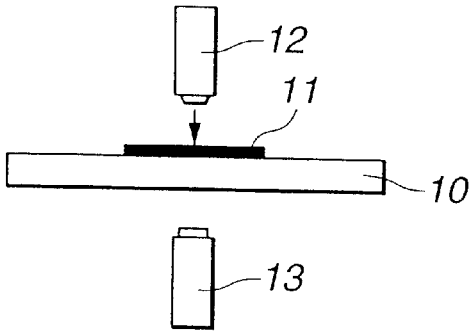
FIG. 2 is another schematic illustration of a transmission type sensor detecting a sensor mark.
Figure 3:
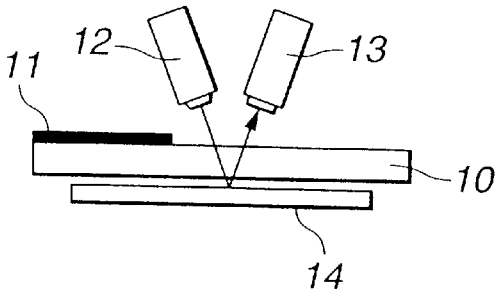
FIG. 3 is a schematic illustration of a transmission/reflection type sensor detecting a sensor mark.
Figure 4:
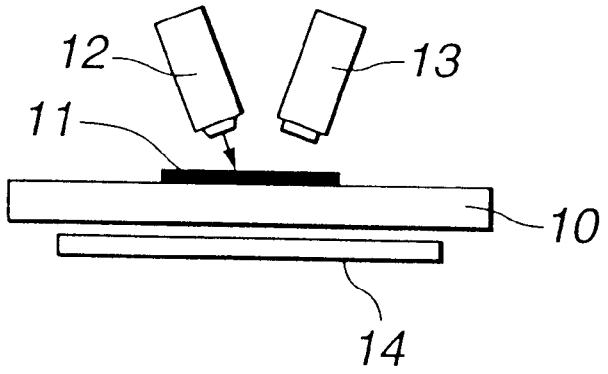
FIG. 4 is another schematic illustration of a transmission/reflection type sensor detecting a sensor mark.
Figure 5:
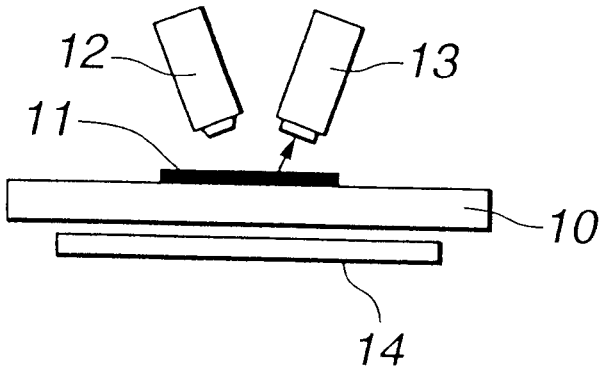
FIG. 5 is another schematic illustration of a transmission/reflection type sensor detection a sensor, where light is reflected by the surface of the sensor mark.
Figure 6:
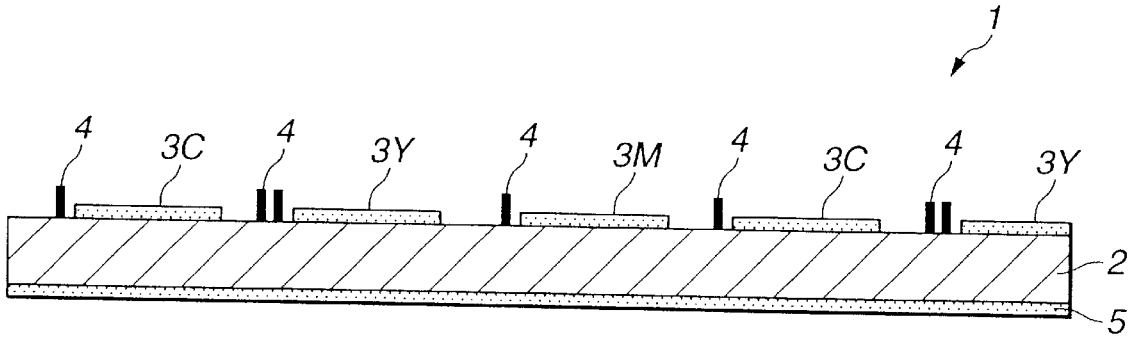
FIG. 6 is a schematic cross sectional view of an embodiment of ink ribbon according to the invention.
Figure 7:
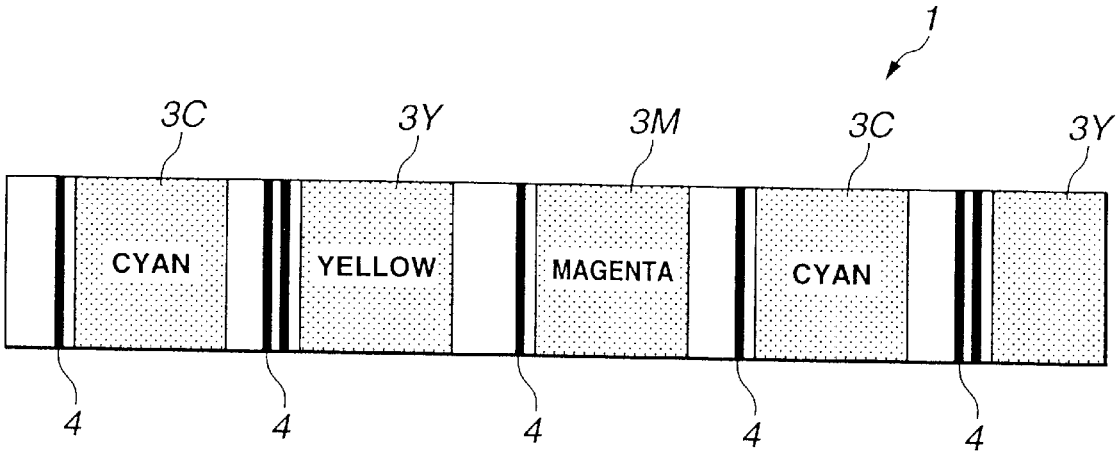
FIG. 7 is a schematic plan view of the embodiment of ink ribbon of FIG. 6.

FIGS. 6 and 7 are schematic illustrations of a first embodiment of ink ribbon according to the invention, showing its configuration.

The ink ribbon 1 comprises a ribon-shaped substrate 2, a yellow ink layer 3Y, a magenta ink layer 3M, a cyan ink layer 3C, said yellow ink layer 3Y, said magenta ink layer 3M and said cyan ink layer 3C being formed on a surface of the substrate 2, sensor marks 4 formed on the same surface of the substrate 2 and arranged in the gaps separating said yellow ink layer 3Y, said magenta ink layer 3M and said cyan ink layer 3C and a back coat layer 5 formed on the other surface of the substrate 2.

The substrate 2 may be made of a sheet of any known appropriate material that can be used for the substrate of an ink ribbon of the type under consideration. Specific examples of materials that can be used for the substrate 2 include polyester film, polystyrene film, polypropylene film, polysulfone film, polycarbonate film, polyimide film and aramid film. The substrate 2 has thickness preferably between 1 $\mu$m and 3 $\mu$m, more preferably between 2 $\mu$m and 10 $\mu$m.

Each of the yellow ink layer 3Y, the magenta ink layer 3M and the cyan ink layer 3C contains a dye and a bonding agent.

Any known yellow dye that can be of the azo type, the dysazo type, the anthraquinone type, the styryl type or the pyridon-azo type may be used for the yellow ink layer 3Y. A specific example of yellow dye is "ESC-155" (trade name) available from Sumitomo Chemical Co., Ltd.

Any known magenta dye that can be of the azo type, the anthraquinone type, the styryl type or the heterocyclic type may be used for the magenta ink layer 3M. A specific example of magenta dye is "ESC-451" (trade name) available from Sumitomo Chemical Co., Ltd.

Any known cyan dye that can be of the anthraquinone type, the naphthoquinone type, the heterocyclic azo type or the indoaniline type may be used for the cyan ink layer 3C. A specific example of cyan dye is "Foron Blue SR-PI" (trade name) available from Sandoz.

The bonding agent may be made of any known resin material that is currently used as such for the ink layers of ink ribbons of the type under consideration. Specific materials that can be used for the boding agent of the ink layers of this embodiment include celllulose type resin materials such as methyl cellulose, ethyl cellulose, hydroxy cellulose, hydroxy-propyl-cellulose and cellulose acetate and vinyl type resin materials such as polyvinyl alcohol, polyvinyl butyral, polyvinyl acetoacetal, polyvinyl acetate and polystyrene along with urethane of various types.

The sensor marks 4 contain first carbon black with an average particle diameter of 30 nm or less, second carbon black with an average particle diameter of 270 nm or more and a binder for dispersing said first carbon black and said second carbon black.

The term "average particle diameter" as used herein refers to the value obtained by selecting 100 carbon black particles or more from a photographic image of the carbon black specimen taken through a transmission type electronic microscope (TEM) and calculating the average of the diameters of the selected particles.

The first carbon black having an average particle diameter of 30 nm or less raises the translucent density of the sensor marks 4, whereas the second carbon black having an average particle diameter of 270 nm or more gives an appropriate level of coarseness and hence a desired level of reflectance to the surface of the sensor marks 4. In other words, by making the sensor marks 4 contain the first carbon black having an average particle diameter of 30 nm or less and the second carbon black having an average particle diameter of 270 nm or more, both the translucent density and the surface reflectance of the sensor marks 4 can be optimized.

Any known appropriate carbon black may be used for the first carbon black. Specific examples of carbon black that can be sued for the first carbon black of the sensor marks 4 include #850B, #980B, MCF88B and #44B (trade names) available from Mitsubishi Chemical Corp., BP-800, BP-L, REGAL-660 and REGAL-330 (trade names) available from CABOT, RAVEN-1255, RAVEN-1250, RAVEN-1020, RAVEN-780 and RAVEN-760 (trade names) available from Columbian Chemicals Company and Printex-55, Printex-45 and SB-550 (trade names) available from Degussa.

Preferably, the first carbon black has an average particle diameter of 25 nm or less. As the average particle diameter of the first carbon black is reduced, the particles become less visible and the translucent density of the sensor marks 4 rises. However, if the average particle diameter is too small, the carbon black particles become less dispersive and less stable in a dispersed state. Therefore, it is also preferable that the first carbon black has an average particle diameter of 15 nm or more.

Specific examples of carbon black that can be used for the second carbon black of the sensor marks 4 include Sevacarb-MT (trade name) available from Columbian Chemicals Company and Thermax MT (trade name) available from Cancarb.

The compounding ratio of the first carbon black to the second carbon black contained in the sensor marks 4 is between 70:30 and 30:70 by weight. If the ratio of the first carbon black is greater than 70 weight portions, that of the second carbon black is reduced accordingly to consequently worsen the surface reflectance of the sensor marks 4. On the other hand, if the ratio of the second carbon black is greater than 70 weight portions, that of the first carbon black is reduced accordingly to consequently worsen the translucent density of the sensor marks 4. In other words, the translucent density of the sensor marks 4 can be improved to reduce the reflectance thereof when the compounding ratio of the first carbon black to the second carbon black is found between 70:30 and 30:70 by weight.

Materials that can be used for the binder for dispersing said first and second carbon blacks include vinyl chloride resin, polyurethane resin, phenoxy resin and polyester resin that may or may not be denatured as well as cellulose esters such as cellulose acetate butylate. Additionally, thermoplastic resins, thermosetting resins, reactive resins and resins that are set when irradiated with electron beams can also be used for the binder.

In the sensor marks 4, the ratio of the binder to said first and second carbon blacks (PB ratio) is preferably between 0.5 and 3. The first and second carbon blacks remain highly stable and operate effectively when the PB ratio is found within this range.

Preferably, the sensor marks 4 have a thickness between 0.5 $\mu$m and 1.5 $\mu$m. The sensor marks 4 do not provide a satisfactory translucent density if their thickness is less than 0.5 $\mu$m, whereas they can give rise to undulations on the surface if they have a thickness greater than 1.5 $\mu$m and the ink ribbon is stored for a prolonged period of time.

If necessary, a hardener may be added to the sensor marks 4 in order to improve their durability. Multi-functional isocyanate can be used as the hardener to be added to the sensor marks 4. Particularly, the use of tolylenediisocyanate (TD) is preferable. Such a hardener is preferably added by 20 to 100 weight portions to 100 portions of the entire resin used for the sensor marks 4. Besides the hardener, an organic pigment, an inorganic pigment and/or a lubricant may be added to the sensor marks 4 whenever necessary.

The back coat layer 5 contains resin. The back coat layer 5 formed on the other surface of the substrate 2 serves to make the ink ribbon 1 frictionally slide on the printing head on a stable basis.

A lubricant and/or a hardener may also be added to the back coat layer 5. The lubricant added to the back coat layer 5 reduces the friction between the ink ribbon 1 and the printing head to improve the movement of the ink ribbon 1 on the printing head. Materials that can be used for the lubricant include calcium carbonate and phosphates. The hardener added to the back coat layer 5 improves the durability of the ink ribbon 1 when the latter is driven to move on the printing head. Polyisocyanate can preferably be used as the hardener.

In another embodiment of ink ribbon 1 according to the invention, the sensor marks 4 have a 45° reflectance of 30% or less to light having a wavelength of 950 nm. Sensor marks 4 having a 45° reflectance of 30% or less to light having a wavelength of 950 nm shows a satisfactorily low surface reflectance and hence the sensor of the printer can reliably detect such sensor marks. In other words, an ink ribbon 1 having such sensor marks 4 can reduce detection errors and hence operates excellently.

The 45° reflectance of 30% or less to light having a wavelength of 950 nm of the sensor marks 4 can be realized by appropriately defining the particle diameter and the compounding ratio of the carbon blacks contained in the sensor marks 4. More specifically, such a reflectance can be realized for the sensor marks 4 by make the latter contain first carbon black with an average particle diameter of 30 nm or less and second carbon black with an average particle diameter of 270 nm or more.

Figure 8:
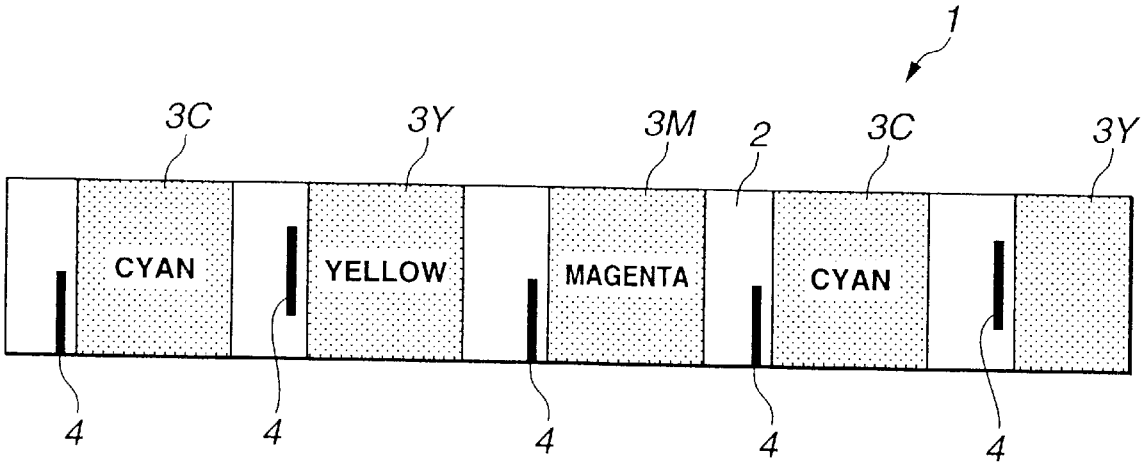
FIG. 8 is a schematic plan view of another embodiment of ink ribbon according to the invention.

While the present invention is described above by way of an embodiment, it should be noted that the present invention is by no means limited to the above embodiments, which may be altered or modified in various different ways without departing from the scope of the invention. For instance, the arrangement of the ink layers and the sensor marks may be varied depending on the type of the printer with which the ink ribbon is used. While the sensor marks 4 are arranged to cross the entire width of the substrate 2 in the above embodiment of ink ribbon according to the invention, the sensor marks 4 do not necessarily have to cross the entire width of the substrate 2 as in the case of the embodiment illustrated in FIG. 8.

EXAMPLES

A number of specimens of ink ribbon according to the invention were prepared and the performances thereof were evaluated in a manner as described below.

Example 1

The paints as listed below were prepared for the sensor marks, the back coat layer, the yellow ink layer, the magenta ink layer and the cyan ink layer of a specimen of ink ribbon according to the invention.

Paint for Sensor Marks

The paint for the sensor marks was prepared by putting the materials as listed below together, mixing and crashing them in a ball mill for several minutes and causing the mixture to pass through a filter having a pore diameter of 5 $\mu$m.

[carbon black]
first carbon black: 20 weight portions
(RAVEN-1255 available from Columbian Chemicals Company
:average particle diameter 23 $\mu$m)
second carbon black: 80 weight portions
(Sevacarb MT available from Columbian Chemicals Company
:average particle diameter 350 $\mu$m)
[resin]
polyester-polyurethane (containing $SO_3Na$ polar groups): 100 weight portions
(UR-8300 available from Toyobo Co., Ltd.)
[solvent]
methyl ethyl ketone: 500 weight portions
toluene: 500 weight portions Paint for Back Coat Layer The paint for the back coat layer was prepared by putting the materials as listed below together, mixing and stirring them in a dissolver for two hours and causing the mixture to pass through a filter having a pore diameter of 50 $\mu$m except the hardener that was added an hour prior to the application of the paint for the back coat layer.

[resin]
polyvinyl butyral: 100 weight portions
(S-LEC BX-55z available from Sekisui Chemical Co., Ltd.)
[lubricant]
calcium carbonate: 10 weight portions
(Hakuenka DD available from Shiraishi Kogyo Co., Ltd.)
phosphate: 10 weight portions (Phosphanol RD-720 available from Toho Chemical Industry Co., Ltd.)
phosphate: 20 weight portions
(Prisurf A208S available from Dai-ichi Kogyo Seiyaku Co., Ltd.)
[solvent]
methyl ethyl ketone: 800 weight portions
toluene: 800 weight portions
[hardener]
polyisocyanate: 50 weight portions
(Coronate L-50E available from Nippon Polyurethane Co., Ltd.)

Paint for Yellow Ink Layer

The paint for the yellow ink layer was prepared by putting the materials as listed below together, mixing and stirring them in a dissolver for two hours and causing the mixture to pass through a filter having a pore diameter of 50 μm.

[dye]
yellow dye: 100 weight portions
(ESC-155 available from Sumitomo Chemical Co., Ltd.)
[resin]
polyvinyl butyral: 100 weight portions
(3000K available from Denki Kagaku Kogyo K. K.)
[solvent]
methyl ethyl ketone: 900 weight portions
toluene: 900 weight portions Paint for Magenta Ink Layer The paint for the magenta ink layer was prepared by putting the materials as listed below together, mixing and stirring them in a dissolver for two hours and causing the mixture to pass through a filter having a pore diameter of 50 μm.

[dye]
magenta dye: 100 weight portions
(ESC-451 available from Sumitomo Chemical Co., Ltd.)
[resin]
polyvinyl butyral: 100 weight portions
(3000K available from Denki Kagaku Kogyo K. K.)
[solvent]
methyl ethyl ketone: 900 weight portions
toluene: 900 weight portions Paint for Cyan Ink Layer The paint for the cyan ink layer was prepared by putting the materials as listed below together, mixing and stirring them in a dissolver for two hours and causing the mixture to pass through a filter having a pore diameter of 50 μm.

[dye]
cyan dye: 100 weight portions
(Foron Blue SR-PI available from Sandoz)
[resin]
polyvinyl butyral: 100 weight portions
(3000K available from Denki Kagaku Kogyo K. K.)
[solvent]
methyl ethyl ketone: 900 weight portions
toluene: 900 weight portions Then, the paint for the back coat layer prepared in a manner as described above was applied to one of the surfaces of a 6 μm thick polyester film (LUMILER available from Toray Industries, Inc.) to a thickness of 1 μm when dried and made to set at 60° C. for 48 hours to produce the back coat layer.

Subsequently, the paint for the sensor marks, the paint for the yellow ink layer, the paint for the magenta ink layer and the paint for the cyan ink layer were applied to the other surface of the ribbon-shaped substrate to a thickness of 1.5 μm for the sensor marks when dried and to a thickness of 1.0 μm for all the ink layers when dried to produce a ink ribbon carrying sensor marks, a yellow ink layer, a magenta ink layer and a cyan ink layer on that surface.

Example 2

A specimen of ink ribbon according to the invention was prepared as in Example 1 except that 30 weight portions of the first carbon black and 70 weight portions of the second carbon black were used for preparing the paint for the sensor marks.

Example 3

A specimen of ink ribbon according to the invention was prepared as in Example 1 except that 50 weight portions of the first carbon black and also 50 weight portions of the second carbon black were used for preparing the paint for the sensor marks.

Example 4

A specimen of ink ribbon according to the invention was prepared as in Example 1 except that 70 weight portions of the first carbon black and 30 weight portions of the second carbon black were used for preparing the paint for the sensor marks.

Example 5

A specimen of ink ribbon according to the invention was prepared as in Example 1 except that 80 weight portions of the first carbon black and 20 weight portions of the second carbon black were used for preparing the paint for the sensor marks.

Example 6

A specimen of ink ribbon according to the invention was prepared as in Example 1 except that RAVEN-760 (average particle diameter 30 nm) available from Columbian Chemicals Company was used for the first carbon black.

Example 7

A specimen of ink ribbon according to the invention was prepared as in Example 1 except that #850B (average particle diameter 18 nm) available from Mitsubishi Plastics, Inc. was used for the first carbon black.

Example 8

A specimen of ink ribbon according to the invention was prepared as in Example 1 except that 50 weight portions of the first carbon black and 50 weight portions of the second carbon black were used for preparing the paint for the sensor marks and the second carbon black was Thermax-MT (average particle diameter 270 nm) available from Cancarb.

Comparative Example 1

A specimen of ink ribbon was prepared as in Example 1 except that 70 weight portions of the first carbon black and 30 weight portions of the second carbon black were used for preparing the paint for the sensor marks and the second carbon black was #35 (average particle diameter 82 nm) available from Asahi Carbon.

Comparative Example 2

A specimen of ink ribbon was prepared as in Example 2 except that Regal 99R (average particle diameter 35 nm) available from CABOT was used for the first carbon black.

The prepared specimens were then evaluated for the translucent density, the surface reflectance and the detection accuracy.

For the evaluation, P-300 Printer, a printer having a reflection type sensor that is available from Olympus Optical Co., Ltd. was used with printing paper supplied by Sony Corp. for VPM-P50STB.

The translucent density was evaluated by means of a Macbeth densitometer. Specimens with a translucent density of 1.5 or more were rated as good.

The surface reflectance was evaluated by means of VG-ID, a reflectometer available from Nihon Denshoku Co., Ltd. More specifically, the 20° Gloss of the surface was observed and specimens with a value of 50 or less were rated as good.

As for the detection accuracy, a printing operation was conducted continuously on a hundred sheets by means of the P-300 Printer of Olympus Optical Co., Ltd. and the number of sensor marks that the sensor of the printer failed to detect at the cost of ink ribbon was counted. Specimens with no undetected sensor marks were rated as good.

Table 1 below shows the results of the evaluation for the specimens of Examples 1 through 8 and Comparative Examples 1 and 2 along with the carbon black compositions of the sensor marks.

From Table 1, it will be seen that the specimen of Comparative Example 1 whose average particle diameter of the second carbon black was smaller than 270 nm had a high surface reflectance and a relative large number of undetected sensor marks, although its translucent density was high. It will also be seen from Table 1 that the specimen of Comparative Example 2 whose average particle diameter of the first carbon black was greater than 30 nm had a low translucent density and a number of undetected sensor marks.

On the other hand, all the specimens of Examples 1 through 8 whose average particle diameter of the first carbon black was 30 nm or less and that of the second carbon black was 270 nm or more were satisfactory in terms of translucent density and surface reflectance and practically free from undetected sensor marks.

Of the specimens, those of Examples 2 through 4 and 6 through 8 that contained the first and second carbon blacks at a ratio between 70:30 and 30:70 by weight were particularly satisfactory in terms of translucent density and surface reflectance and totally free from undetected sensor marks.

From the above, it is found that an ink ribbon according to the invention and provided with sensor marks containing first carbon black with an average particle diameter of 30 nm or less and second carbon black with an average particle diameter of 270 nm or more can satisfy both the requirement of a high translucent density and that of a low surface reflectance to minimize detection errors and is free from the problem of undetected sensor marks when used with a printer having a sensor.

It is also found that the advantages of the present invention is particularly remarkable when the content ratio of the first and second carbon blacks is between 70:30 and 30:70.

TABLE 1

| | first carbon black | | second carbon black | | | | |
|---|---|---|---|---|---|---|---|
| | average particle diameter [nm] | content [weight portions] | average particle diameter [nm] | content [weight portions] | translucent density | 20° Gloss | number of undetected [marks] |
| Example 1 | 23 | 20 | 350 | 80 | 1.48 | 3.8 | 2/100 |
| Example 2 | 23 | 30 | 350 | 70 | 1.61 | 4.3 | 0/100 |
| Example 3 | 23 | 50 | 350 | 50 | 1.92 | 21.5 | 0/100 |
| Example 4 | 23 | 70 | 350 | 30 | 2.20 | 43.0 | 0/100 |
| Example 5 | 23 | 80 | 350 | 20 | 2.30 | 49.3 | 3/100 |
| Example 6 | 30 | 30 | 350 | 70 | 1.53 | 4.0 | 0/100 |
| Example 7 | 18 | 30 | 350 | 70 | 1.70 | 6.1 | 0/100 |
| Example 8 | 23 | 50 | 350 | 50 | 2.00 | 23.7 | 0/100 |
| Comparative Example 1 | 23 | 70 | 82 | 30 | 2.23 | 52.0 | 5/100 |
| Comparative Example 2 | 35 | 30 | 350 | 70 | 1.42 | 4.2 | 2/100 |

Example 9

The paints as listed below were prepared for the sensor marks, the back coat layer, the yellow ink layer, the magenta ink layer and the cyan ink layer of a specimen of ink ribbon according to the invention.

Paint for Sensor Marks

The paint for the sensor marks was prepared by putting the materials as listed below together, mixing and crashing them in a ball mill for several minutes and causing the mixture to pass through a filter having a pore diameter of 5 μm.

[carbon black]

first carbon black: 20 weight portions (RAVEN-1255 available from Columbian Chemicals Company :average particle diameter 23 μm)

second carbon black: 80 weight portions (Sevacarb MT available from Columbian Chemicals Company :average particle diameter 350 μm)

[resin]

polyester-polyurethane (containing $SO_3Na$ polar groups): 100 weight portions (UR-8300 available from Toyobo Co., Ltd.) [solvent]

methyl ethyl ketone: 500 weight portions toluene: 500 weight portions

Paint for Back Coat Layer

The paint for the back coat layer was prepared by putting the materials as listed below together, mixing and stirring them in a dissolver for two hours and causing the mixture to pass through a filter having a pore diameter of 50 μm except the hardener that was added an hour prior to the application of the paint for the back coat layer.

[resin]
polyvinyl butyral: 100 weight portions
(S-LEC BX-55z available from Sekisui Chemical Co., Ltd.)
[lubricant]
calcium carbonate: 10 weight portions
(Hakuenka DD available from Shiraishi Kogyo Co., Ltd.)
phosphate: 10 weight portions
(Phosphanol RD-720 available from Toho Chemical Industry Co., Ltd.)
phosphate: 20 weight portions
(Prisurf A208S available from Dai-ichi Kogyo Seiyaku Co., Ltd.)
[solvent]
methyl ethyl ketone: 800 weight portions
toluene: 800 weight portions
[hardener]
polyisocyanate: 50 weight portions
(Coronate L-50E available from Nippon Polyurethane Co., Ltd.)

Paint for Yellow Ink Layer

The paint for the yellow ink layer was prepared by putting the materials as listed below together, mixing and stirring them in a dissolver for two hours and causing the mixture to pass through a filter having a pore diameter of 50 μm.

[dye]
yellow dye: 100 weight portions
(ESC-155 available from Sumitomo Chemical Co., Ltd.)
[resin]
polyvinyl butyral: 100 weight portions
(3000K available from Denki Kagaku Kogyo K. K.)
[solvent]
methyl ethyl ketone: 900 weight portions
toluene: 900 weight portions Paint for Magenta Ink Layer The paint for the magenta ink layer was prepared by putting the materials as listed below together, mixing and stirring them in a dissolver for two hours and causing the mixture to pass through a filter having a pore diameter of 50 μm.

[dye]
magenta dye: 50 weight portions
(ESC-451 available from Sumitomo Chemical Co., Ltd.)
[resin]
polyvinyl butyral: 50 weight portions
(3000K available from Denki Kagaku Kogyo K. K.)
[solvent]
methyl ethyl ketone: 900 weight portions
toluene: 900 weight portions Paint for Cyan Ink Layer The paint for the cyan ink layer was prepared by putting the materials as listed below together, mixing and stirring them in a dissolver for two hours and causing the mixture to pass through a filter having a pore diameter of 50 μm.

[dye]
cyan dye: 100 weight portions
(Foron Blue SR-PI available from Sandoz)
[resin]
polyvinyl butyral: 100 weight portions
(3000K available from Denki Kagaku Kogyo K. K.)
[solvent]
methyl ethyl ketone: 900 weight portions
toluene: 900 weight portions Then, the paint for the back coat layer prepared in a manner as described above was applied to one of the surfaces of a 6 μm thick polyester film (LUMILER available from Toray Industries, Inc.) to a thickness of 1 μm when dried and made to set at 60° C. for 48 hours to produce the back coat layer.

Subsequently, the paint for the sensor marks, the paint for the yellow ink layer, the paint for the magenta ink layer and the paint for the cyan ink layer were applied to the other surface of the ribbon-shaped substrate to a thickness of 1.5 μm for the sensor marks when dried and to a thickness of 1.0 μm for all the ink layers when dried to produce a ink ribbon carrying sensor marks, a yellow ink layer, a magenta ink layer and a cyan ink layer on that surface.

Example 10

A specimen of ink ribbon according to the invention was prepared as in Example 9 except that 50 weight portions of the first carbon black and also 50 weight portions of the second carbon black were used for preparing the paint for the sensor marks.

Comparative Example 3

A specimen of ink ribbon according to the invention was prepared as in Example 9 except that 60 weight portions of the first carbon black and 40 weight portions of the second carbon black were used for preparing the paint for the sensor marks.

Comparative Example 4

A specimen of ink ribbon according to the invention was prepared as in Example 9 except that 70 weight portions of the first carbon black and 30 weight portions of the second carbon black were used for preparing the paint for the sensor marks.

The prepared specimens were then evaluated for the 45° reflectance to light with a wavelength of 950 nm and the detection accuracy.

For the evaluation, P-300 Printer, a printer having a reflection type sensor that is available from Olympus Optical Co., Ltd, was used with printing paper supplied by Sony Corp. for VPM-P50STB.

The 45° reflectance to light with a wavelength of 950 nm was evaluated by means of spectro-photometer MCPD-2000 available from Otsuka Denshi Co., Ltd. The 45° reflectance to light with a wavelength of 950 nm of a standard white panel as defined in JIS-P-8148 was rated as 100% and the corresponding reflectance of the sensor marks of each of the specimens was evaluated.

As for the detection accuracy, a printing operation was conducted continuously on a hundred sheets by means of the P-300 Printer of Olympus Optical Co., Ltd and the number of sensor marks that the sensor of the printer failed to detect at the cost of ink ribbon was counted. Specimens with no undetected sensor marks were rated as good. When evaluating the detection accuracy, the optical sensor of the printer was so adjusted that it was apt to fail to detect sensor marks.

Table 2 below shows the results of the evaluation for the specimens of Examples 9 and 10 and Comparative Examples 3 and 4 along with the carbon black compositions of the sensor marks.

From Table 2, it will be seen that an ink ribbon showing a 45° reflectance to light with a wavelength of 950 nm of 30% or less can totally eliminate undetected sensor marks.

TABLE 2

| | first carbon black | | second carbon black | | 45° reflectance | number of |
|---|---|---|---|---|---|---|
| | average particle diameter [nm] | content [weight portions] | average particle diameter [nm] | content [weight portions] | to to 950 nm wave-length light (%) | undetected sensor [marks] |
| Example 9 | 23 | 30 | 350 | 70 | 28 | 0/100 |
| Example 10 | 23 | 50 | 350 | 50 | 14 | 0/100 |
| Comparative example 3 | 23 | 60 | 350 | 40 | 36 | 1/100 |
| Comparative example 4 | 23 | 70 | 350 | 30 | 43 | 36/100 |

What is claimed is:

1. An ink ribbon adapted to be used for a sublimation type thermal transfer printer, said ink ribbon comprising:

a ribbon-shaped substrate;

ink layers formed on a surface of said substrate and containing dyes;

sensor marks formed on said surface of said substrate; and a back coat layer formed on the other surface of said substrate;

said sensor marks containing first carbon black with an average particle diameter of 30 nm or less and second carbon black with an average particle diameter of 270 nm or more, wherein the compounding ratio of the first carbon black to the second carbon black contained in the sensor marks is between 70:30 and 30:70 by weight.

2. An ink ribbon adapted to be used for a sublimation type thermal transfer printer, said ink ribbon comprising:

a ribbon-shaped substrate;

ink layers formed on a surface of said substrate and containing dyes; and sensor marks formed on said surface of said substrate carrying said ink layers;

said sensor marks having a 45° reflectance of 30% or less to light with a wavelength of 950 nm, said sensor marks containing first carbon black with an average particle diameter of 30 nm or less and second carbon black with an average particle diameter of 270 nm or more, wherein the compounding ratio of the first carbon black to the second carbon black contained in the sensor marks is between 70:30 and 30:70 by weight.

3. An ink ribbon according to claim 2, wherein a back coat layer is formed on the other surface of said substrate.

* * * * *